US007845435B2

(12) United States Patent
Zahradnik et al.

(10) Patent No.: US 7,845,435 B2
(45) Date of Patent: Dec. 7, 2010

(54) HYBRID DRILL BIT AND METHOD OF DRILLING

(75) Inventors: Anton F. Zahradnik, Sugarland, TX (US); Rudolf Carl Pessier, The Woodlands, TX (US); Don Q. Nguyen, Houston, TX (US); Michael Steven Damschen, Houston, TX (US); Karlos B. Cepeda, Fort Worth, TX (US); Tim King Marvel, Churchlands (AU); Matt Meiners, Kuala Lumpur (MY)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 12/061,536

(22) Filed: Apr. 2, 2008

(65) Prior Publication Data

US 2008/0264695 A1 Oct. 30, 2008

Related U.S. Application Data

(63) Continuation-in-part of application No. 11/784,025, filed on Apr. 5, 2007.

(51) Int. Cl.
*E21B 10/14* (2006.01)
*E21B 10/43* (2006.01)

(52) U.S. Cl. ..... 175/336; 175/376; 175/431

(58) Field of Classification Search ..... 175/336, 175/376, 431

See application file for complete search history.

(56) References Cited

U.S. PATENT DOCUMENTS 930,759 A 8/1909 Hughes
1,874,066 A 8/1932 Scott et al.
1,879,127 A 9/1932 Schlumpf
1,932,487 A 10/1933 Scott
2,030,722 A 2/1936 Scott
2,198,849 A 4/1940 Waxler
2,216,894 A 10/1940 Stancliff
2,297,157 A 9/1942 McClinton
2,719,026 A 9/1955 Boice (Continued)

FOREIGN PATENT DOCUMENTS

EP 0225101 6/1987

(Continued)

OTHER PUBLICATIONS

International Search Report for corresponding International patent application No. PCT/US2008/083532.

(Continued)

*Primary Examiner*—Giovanna C Wright
(74) *Attorney, Agent, or Firm*—Locke Lord Bissell & Liddell LLP

(57) ABSTRACT

A hybrid drill bit having both roller cones and fixed blades is disclosed, and a method of drilling. The cutting elements on the fixed blades form a continuous cutting profile from the perimeter of the bit body to the axial center. The roller cone cutting elements overlap with the fixed cutting elements in the nose and shoulder sections of the cutting profile between the axial center and the perimeter. The roller cone cutting elements crush and pre- or partially fracture formation in the confined and highly stressed nose and shoulder sections.

34 Claims, 7 Drawing Sheets

U.S. PATENT DOCUMENTS

| | | | |
|---|---|---|---|
| 3,010,708 | A | 11/1961 | Hlinsky et al. |
| 3,055,443 | A | 9/1962 | Edwards |
| 3,174,564 | A | 3/1965 | Morlan |
| 3,269,469 | A | 8/1966 | Kelly, Jr. |
| 3,424,258 | A | 1/1969 | Nakayama |
| RE28,625 | E | 11/1975 | Cunningham |
| 4,006,788 | A | 2/1977 | Garner |
| 4,140,189 | A | 2/1979 | Garner |
| 4,190,126 | A | 2/1980 | Kabashima |
| 4,270,812 | A | 6/1981 | Thomas |
| 4,285,409 | A | 8/1981 | Allen |
| 4,293,048 | A | 10/1981 | Kloesel, Jr. |
| 4,320,808 | A | 3/1982 | Garrett |
| 4,343,371 | A | 8/1982 | Baker, III et al. |
| 4,359,112 | A | 11/1982 | Garner et al. |
| 4,369,849 | A | 1/1983 | Parrish |
| 4,410,284 | A | 10/1983 | Herrick |
| 4,444,281 | A | 4/1984 | Schumacher, Jr. et al. |
| 4,527,637 | A | 7/1985 | Bodine |
| 4,572,306 | A | 2/1986 | Dorosz |
| 4,657,091 | A | 4/1987 | Higdon |
| 4,664,705 | A | 5/1987 | Horton et al. |
| 4,690,228 | A | 9/1987 | Voelz et al. |
| 4,726,718 | A | 2/1988 | Meskin et al. |
| 4,727,942 | A | 3/1988 | Galle et al. |
| 4,738,322 | A | 4/1988 | Hall et al. |
| 4,765,205 | A | 8/1988 | Higdon |
| 4,874,047 | A | 10/1989 | Hixon |
| 4,875,532 | A | 10/1989 | Langford, Jr. |
| 4,892,159 | A | 1/1990 | Holster |
| 4,915,181 | A | 4/1990 | Labrosse |
| 4,932,484 | A | 6/1990 | Warren et al. |
| 4,936,398 | A | 6/1990 | Auty et al. |
| 4,943,488 | A | 7/1990 | Sung et al. |
| 4,953,641 | A | 9/1990 | Pessier |
| 4,984,643 | A | 1/1991 | Isbell et al. |
| 4,991,671 | A | 2/1991 | Pearce et al. |
| 5,016,718 | A | 5/1991 | Tandberg |
| 5,027,912 | A | 7/1991 | Juergens |
| 5,028,177 | A | 7/1991 | Meskin et al. |
| 5,030,276 | A | 7/1991 | Sung et al. |
| 5,049,164 | A | 9/1991 | Horton et al. |
| 5,116,568 | A | 5/1992 | Sung et al. |
| 5,145,017 | A | 9/1992 | Holster et al. |
| 5,176,212 | A | 1/1993 | Tandberg |
| 5,224,560 | A | 7/1993 | Fernandez |
| 5,238,074 | A | 8/1993 | Tibbitts et al. |
| 5,287,936 | A | 2/1994 | Grimes et al. |
| 5,289,889 | A | 3/1994 | Gearhart et al. |
| 5,337,843 | A | 8/1994 | Torgrimsen et al. |
| 5,346,026 | A | 9/1994 | Pessier et al. |
| 5,429,200 | A | 7/1995 | Blackman et al. |
| 5,439,068 | A | 8/1995 | Huffstutler et al. |
| 5,452,771 | A | 9/1995 | Blackman et al. |
| 5,467,836 | A | 11/1995 | Grimes et al. |
| 5,513,715 | A | 5/1996 | Dysart |
| 5,518,077 | A | 5/1996 | Blackman et al. |
| 5,547,033 | A | 8/1996 | Campos, Jr. |
| 5,553,681 | A | 9/1996 | Huffstutler et al. |
| 5,558,170 | A | 9/1996 | Thigpen et al. |
| 5,570,750 | A | 11/1996 | Williams |
| 5,593,231 | A | 1/1997 | Ippolito |
| 5,606,895 | A | 3/1997 | Huffstutler |
| 5,624,002 | A | 4/1997 | Huffstutler |
| 5,641,029 | A | 6/1997 | Beaton et al. |
| 5,644,956 | A | 7/1997 | Blackman et al. |
| 5,655,612 | A | 8/1997 | Grimes et al. |
| D384,084 | S | 9/1997 | Huffstutler et al. |
| 5,695,018 | A | 12/1997 | Pessier et al. |
| 5,695,019 | A | 12/1997 | Shamburger, Jr. |
| 5,755,297 | A | 5/1998 | Young et al. |
| 5,862,871 | A | 1/1999 | Curlett |
| 5,868,502 | A | 2/1999 | Cariveau et al. |
| 5,873,422 | A | 2/1999 | Hansen et al. |
| 5,941,322 | A | 8/1999 | Stephenson et al. |
| 5,944,125 | A | 8/1999 | Byrd |
| 5,967,246 | A | 10/1999 | Caraway et al. |
| 5,979,576 | A | 11/1999 | Hansen et al. |
| 5,988,303 | A | 11/1999 | Arfele |
| 5,992,542 | A | 11/1999 | Rives |
| 5,996,713 | A | 12/1999 | Pessier et al. |
| 6,092,613 | A | 7/2000 | Caraway et al. |
| 6,095,265 | A | 8/2000 | Alsup |
| 6,109,375 | A | 8/2000 | Tso |
| 6,173,797 | B1 | 1/2001 | Dykstra et al. |
| 6,220,374 | B1 | 4/2001 | Crawford |
| 6,241,036 | B1 | 6/2001 | Lovato et al. |
| 6,260,635 | B1 | 7/2001 | Crawford |
| 6,279,671 | B1 | 8/2001 | Panigrahi et al. |
| 6,283,233 | B1 | 9/2001 | Lamine et al. |
| 6,296,069 | B1 | 10/2001 | Lamine et al. |
| RE37,450 | E | 11/2001 | Deken et al. |
| 6,360,831 | B1 | 3/2002 | Akesson et al. |
| 6,386,302 | B1 | 5/2002 | Beaton |
| 6,401,844 | B1 | 6/2002 | Doster et al. |
| 6,405,811 | B1 | 6/2002 | Borchardt |
| 6,408,958 | B1 | 6/2002 | Isbell et al. |
| 6,415,687 | B2 | 7/2002 | Saxman |
| 6,439,326 | B1 | 8/2002 | Huang et al. |
| 6,446,739 | B1 | 9/2002 | Richman et al. |
| 6,450,270 | B1 | 9/2002 | Saxton |
| 6,474,424 | B1 | 11/2002 | Saxman |
| 6,510,906 | B1 | 1/2003 | Richert et al. |
| 6,510,909 | B2 | 1/2003 | Portwood et al. |
| 6,527,066 | B1 | 3/2003 | Rives |
| 6,533,051 | B1 | 3/2003 | Singh et al. |
| 6,544,308 | B2 | 4/2003 | Griffin et al. |
| 6,562,462 | B2 | 5/2003 | Griffin et al. |
| 6,568,490 | B1 | 5/2003 | Tso et al. |
| 6,585,064 | B2 | 7/2003 | Griffin et al. |
| 6,589,640 | B2 | 7/2003 | Griffin et al. |
| 6,592,985 | B2 | 7/2003 | Griffin et al. |
| 6,601,661 | B2 | 8/2003 | Baker et al. |
| 6,601,662 | B2 | 8/2003 | Matthias et al. |
| 6,684,967 | B2 | 2/2004 | Mensa-Wilmot et al. |
| 6,729,418 | B2 | 5/2004 | Slaughter, Jr. et al. |
| 6,739,214 | B2 | 5/2004 | Griffin et al. |
| 6,742,607 | B2 | 6/2004 | Beaton |
| 6,749,033 | B2 | 6/2004 | Griffin et al. |
| 6,797,326 | B2 | 9/2004 | Griffin et al. |
| 6,843,333 | B2 | 1/2005 | Richert et al. |
| 6,861,098 | B2 | 3/2005 | Griffin et al. |
| 6,861,137 | B2 | 3/2005 | Griffin et al. |
| 6,878,447 | B2 | 4/2005 | Griffin et al. |
| 6,883,623 | B2 | 4/2005 | McCormick et al. |
| 6,986,395 | B2 | 1/2006 | Chen |
| 6,988,569 | B2 | 1/2006 | Lockstedt et al. |
| 7,096,978 | B2 | 8/2006 | Dykstra et al. |
| 7,111,694 | B2 | 9/2006 | Beaton |
| 7,137,460 | B2 | 11/2006 | Slaughter, Jr. et al. |
| 7,152,702 | B1 | 12/2006 | Bhome et al. |
| 7,234,550 | B2 | 6/2007 | Azar et al. |
| 7,350,568 | B2 | 4/2008 | Mandal et al. |
| 7,350,601 | B2 | 4/2008 | Belnap et al. |
| 7,360,612 | B2 | 4/2008 | Chen et al. |
| 7,377,341 | B2 | 5/2008 | Middlemiss et al. |
| 7,387,177 | B2 | 6/2008 | Zahradnik et al. |
| 7,392,862 | B2 | 7/2008 | Zahradnik et al. |
| 7,398,837 | B2 | 7/2008 | Hall et al. |
| 7,416,036 | B2 | 8/2008 | Forstner et al. |
| 7,435,478 | B2 | 10/2008 | Keshavan |
| 7,462,003 | B2 | 12/2008 | Middlemiss |
| 7,473,287 | B2 | 1/2009 | Belnap et al. |
| 7,493,973 | B2 | 2/2009 | Keshavan et al. |

| | | | | |
|---|---|---|---|---|
| 7,517,589 | B2 | 4/2009 | Eyre | |
| 7,533,740 | B2 | 5/2009 | Zhang et al. | |
| 7,568,534 | B2 | 8/2009 | Griffin et al. | |
| 2005/0087370 | A1 | 4/2005 | Ledgerwood, III et al. | |
| 2005/0178587 | A1 | 8/2005 | Witman, IV et al. | |
| 2005/0183892 | A1 * | 8/2005 | Oldham et al. | 175/402 |
| 2005/0263328 | A1 | 12/2005 | Middlemiss | |
| 2005/0273301 | A1 | 12/2005 | Huang | |
| 2006/0032674 | A1 | 2/2006 | Chen et al. | |
| 2006/0032677 | A1 | 2/2006 | Azar et al. | |
| 2006/0162969 | A1 | 7/2006 | Belnap et al. | |
| 2006/0196699 | A1 | 9/2006 | Estes et al. | |
| 2006/0254830 | A1 | 11/2006 | Radtke | |
| 2006/0266558 | A1 | 11/2006 | Middlemiss et al. | |
| 2006/0266559 | A1 | 11/2006 | Keshavan et al. | |
| 2006/0278442 | A1 | 12/2006 | Kristensen | |
| 2006/0283640 | A1 | 12/2006 | Estes et al. | |
| 2007/0029114 | A1 | 2/2007 | Middlemiss | |
| 2007/0062736 | A1 | 3/2007 | Cariveau et al. | |
| 2007/0079994 | A1 | 4/2007 | Middlemiss | |
| 2007/0187155 | A1 | 8/2007 | Middlemiss | |
| 2008/0066970 | A1 | 3/2008 | Zahradnik et al. | |
| 2008/0264695 | A1 | 10/2008 | Zahradnik et al. | |
| 2008/0296068 | A1 | 12/2008 | Zahradnik et al. | |
| 2009/0114454 | A1 | 5/2009 | Belnap et al. | |
| 2009/0126998 | A1 | 5/2009 | Zahradnik et al. | |
| 2009/0159338 | A1 | 6/2009 | Buske | |
| 2009/0159341 | A1 | 6/2009 | Pessier et al. | |
| 2009/0166093 | A1 | 7/2009 | Pessier et al. | |
| 2009/0178855 | A1 | 7/2009 | Zhang et al. | |
| 2009/0183925 | A1 | 7/2009 | Zhang et al. | |

FOREIGN PATENT DOCUMENTS

| | | |
|---|---|---|
| EP | 0225101 A | 6/1987 |
| EP | 0157278 | 11/1989 |
| EP | 0391683 | 1/1996 |
| EP | 2089187 | 8/2009 |
| GB | 2183694 | 6/1987 |
| WO | 8502223 | 5/1985 |
| WO | 2008124572 | 10/2008 |

OTHER PUBLICATIONS

Written Opinion for corresponding International patent application No. PCT/US2008/083532.

Sheppard, N. and Dolly, B. "Rock Drilling—Hybrid Bit Success for Syndax3 Pins." Industrial Diamond Review, Jun. 1993, pp. 309-311.

Tomlinson, P. and Clark, I. "Rock Drilling—Syndax3 Pins-New Concepts in PCD Drilling." Industrial Diamond Review, Mar. 1992, pp. 109-114.

Williams, J. and Thompson, A. "An Analysis of the Performance of PDC Hybrid Drill Bits." SPE/IADC 16117, SPE/IADC Drilling Conference, Mar. 1987, pp. 585-594.

Warren, T. and Sinor L. "PDC Bits: What's Needed to Meet Tomorrow's Challenge." SPE 27978, University of Tulsa Centennial Petroleum Engineering Symposium, Aug. 1994, pp. 207-214.

Smith Services. "Hole Opener—Model 6980 Hole Opener." [retrieved from the Internet on May 7, 2008 using <URL: http://www.siismithservices.com/b_products/product_page.asp?ID=589>].

Mills Machine Company, Inc. "Rotary Hole Openers—Section 8." [retrieved from the Internet on Apr. 27, 2009 using <URL: http://www.millsmachine.com/pages/home_page/mills_catalog/cat_holeopen/cat_holeopen.pdf>].

Ersoy, A. and Waller, M. "Wear characteristics of PDC pin and hybrid core bits in rock drilling." Wear 188, Elsevier Science S.A., Mar. 1995, pp. 150-165.

R. Buske, C. Rickabaugh, J. Bradford, H. Lukasewich and J. Overstreet. "Performance Paradigm Shift: Drilling Vertical and Directional Sections Through Abrasive Formations with Roller Cone Bits." Society of Petroleum Engineers—SPE 114975, CIPC/SPE Gas Technology Symposium 2008 Joint Conference, Canada, Jun. 16-19, 2008.

Dr. M. Wells, T. Marvel and C. Beuershausen. "Bit Balling Mitigation in PDC Bit Design." International Association of Drilling Contractors/Society of Petroleum Engineers—IADC/SPE 114673, IADC/SPE Asia Pacific Drilling Technology Conference and Exhibition, Indonesia, Aug. 25-27, 2008.

B. George, E. Grayson, R. Lays, F. Felderhoff, M. Doster and M. Holmes. "Significant Cost Savings Achieved Through the Use of PDC Bits in Compressed Air/Foam Applications." Society of Petroleum Engineers—SPE 116118, 2008 SPE Annual Technical Conference and Exhibition, Denver, Colorado, Sep. 21-24, 2008.

Jung Hye Lee, International Search Report for International Patent Application No. PCT/US2009/042514, Korean Intellectual Property Office, dated Nov. 27, 2009.

Jung Hye Lee, Written Opinion for International Patent Application No. PCT/US2009/042514, Korean Intellectual Property Office, dated Nov. 27, 2009.

Sung Joon Lee, International Search Report for International Patent Application No. PCT/US2009/050672, Korean Intellectual Property Office, dated Mar. 3, 2010.

Sung Joon Lee, Written Opinion for International Patent Application No. PCT/US2009/050672, Korean Intellectual Property Office, dated Mar. 3, 2010.

Pessier, R. and Damschen, M., "Hybrid Bits Offer Distinct Advantages in Selected Roller Cone and PDC Bit Applications," IADC/SPE Drilling Conference and Exhibition, Feb. 2-4, 2010, New Orleans.

International Search Report for International Patent Application No. PCT/US2009/067969, Korean Intellectual Property Office, dated May 25, 2010.

Written Opinion for International Patent Application No. PCT/US2009/067969, Korean Intellectual Property Office, dated May 25, 2010.

* cited by examiner

HYBRID DRILL BIT AND METHOD OF DRILLING

CROSS-REFERENCE TO RELATED APPLICATION

This application is a continuation-in-part of co-pending application Ser. No. 11/784,025, filed Apr. 5, 2007, entitled FIXED CUTTERS AS THE SOLE CUTTING ELEMENTS IN THE AXIAL CENTER OF THE DRILL BIT.

BACKGROUND OF THE INVENTION

1. Technical Field

The present invention relates in general to earth-boring drill bits and, in particular, to a bit having a combination of rolling and fixed cutters and cutting elements and a method of drilling with same.

2. Description of the Related Art

The success of rotary drilling enabled the discovery of deep oil and gas reservoirs and production of enormous quantities of oil. The rotary rock bit was an important invention that made the success of rotary drilling possible. Only soft earthen formations could be penetrated commercially with the earlier drag bit and cable tool, but the two-cone rock bit, invented by Howard R. Hughes, U.S. Pat. No. 930,759, drilled the caprock at the Spindletop field, near Beaumont, Tex. with relative ease. That venerable invention, within the first decade of the last century, could drill a scant fraction of the depth and speed of the modern rotary rock bit. The original Hughes bit drilled for hours, the modern bit drills for days. Modern bits sometimes drill for thousands of feet instead of merely a few feet. Many advances have contributed to the impressive improvements in rotary rock bits.

In drilling boreholes in earthen formations using rolling-cone or rolling-cutter bits, rock bits having one, two, or three rolling cutters rotatably mounted thereon are employed. The bit is secured to the lower end of a drillstring that is rotated from the surface or by a downhole motor or turbine. The cutters mounted on the bit roll and slide upon the bottom of the borehole as the drillstring is rotated, thereby engaging and disintegrating the formation material to be removed. The rolling cutters are provided with cutting elements or teeth that are forced to penetrate and gouge the bottom of the borehole by weight from the drillstring. The cuttings from the bottom and sides of the borehole are washed away by drilling fluid that is pumped down from the surface through the hollow, rotating drillstring, and are carried in suspension in the drilling fluid to the surface.

Rolling-cutter bits dominated petroleum drilling for the greater part of the $20^{th}$ century. With improvements in synthetic or manmade diamond technology that occurred in the 1970s and 1980s, the fixed-cutter, or "drag" bit became popular again in the latter part of the $20^{th}$ century. Modern fixed-cutter bits are often referred to as "diamond" or "PDC" (polycrystalline diamond compact) bits and are far removed from the original fixed-cutter bits of the $19^{th}$ and early $20^{th}$ centuries. Diamond or PDC bits carry cutting elements comprising polycrystalline diamond compact layers or "tables" formed on and bonded to a supporting substrate, conventionally of cemented tungsten carbide, the cutting elements being arranged in selected locations on blades or other structures on the bit body with the diamond tables facing generally in the direction of bit rotation. Diamond bits have an advantage over rolling-cutter bits in that they generally have no moving parts. The drilling mechanics and dynamics of diamond bits are different from those of rolling-cutter bits precisely because they have no moving parts. During drilling operation, diamond bits are used in a manner similar to that for rolling cutter bits, the diamond bits also being rotated against a formation being drilled under applied weight on bit to remove formation material. Engagement between the diamond cutting elements and the borehole bottom and sides shears or scrapes material from the formation, instead of using a crushing action as is employed by rolling-cutter bits. Rolling-cutter and diamond bits each have particular applications for which they are more suitable than the other; neither type of bit is likely to completely supplant the other in the foreseeable future.

In the prior art, some earth-boring bits use a combination of one or more rolling cutters and one or more fixed blades. Some of these combination-type drill bits are referred to as hybrid bits. Previous designs of hybrid bits, such as is described in U.S. Pat. No. 4,343,371, to Baker, III, have provided for the rolling cutters to do most of the formation cutting, especially in the center of the hole or bit. Other types of combination bits are known as "core bits," such as U.S. Pat. No. 4,006,788, to Garner. Core bits typically have truncated rolling cutters that do not extend to the center of the bit and are designed to remove a core sample of formation by drilling down, but around, a solid cylinder of the formation to be removed from the borehole generally intact.

Another type of hybrid bit is described in U.S. Pat. No. 5,695,019, to Shamburger, Jr., wherein the rolling cutters extend almost entirely to the center. Fixed cutter inserts 50 (FIGS. 2 and 3) are located in the dome area 2 or "crotch" of the bit to complete the removal of the drilled formation. Still another type of hybrid bit is sometimes referred to as a "hole opener," an example of which is described in U.S. Pat. No. 6,527,066. A hole opener has a fixed threaded protuberance that extends axially beyond the rolling cutters for the attachment of a pilot bit that can be a rolling cutter or fixed cutter bit. In these latter two cases the center is cut with fixed cutter elements but the fixed cutter elements do not form a continuous, uninterrupted cutting profile from the center to the perimeter of the bit.

Although each of these bits is workable for certain limited applications, an improved hybrid earth-boring bit with enhanced drilling performance would be desirable.

SUMMARY OF THE INVENTION

Embodiments of the present invention comprise an improved earth-boring bit of the hybrid variety. One embodiment comprises an earth-boring bit including a bit body configured at its upper extent for connection into a drillstring, the bit body having a central axis and a radially outermost gage surface. At least one fixed blade extends downward from the bit body in the axial direction, the at least one fixed blade having a leading edge and a trailing edge. At least one rolling cutter is mounted for rotation on the bit body, the at least one rolling cutter having a leading side and a trailing side. At least one nozzle is mounted in the bit body proximal the central axis. The nozzle is arranged to direct a stream of pressurized drilling fluid between the leading edge of the fixed blade and the trailing side of the rolling cutter. At least one rolling-cutter cutting element, which also may be termed "inserts" or "rolling-cutter cutting elements" are arranged on the rolling cutter and radially spaced apart from the central axis of the bit body. A plurality of cutting elements, hereinafter referred to as "fixed-blade cutting elements" for convenience are arranged on the leading edge of the at least one fixed blade. At least one of the fixed-blade cutting elements on the at least one fixed blade is located proximal the central axis of the bit.

According to an embodiment of the present invention, the rolling-cutter cutting elements and the fixed-blade cutting elements combine to define a cutting profile that extends from substantially the central axis to the gage surface of the bit body, the fixed-blade cutting elements forming a substantial portion of the cutting profile at the central axis and the gage surface, and the rolling-cutter cutting elements overlapping the cutting profile of the fixed-blade cutting elements between the axial center and the gage surface.

According to an embodiment of the present invention, a junk slot is formed between the trailing side of the at least one rolling cutter, the leading edge of the at least one fixed blade, and a portion of the bit body, the junk slot providing an area for removal of disintegrated formation material, the junk slot being equal to or larger in at least an angular dimension than a space between the leading side of the at least one rolling cutter and the trailing edge of the at least one fixed blade.

According to an embodiment of the present invention, the at least one nozzle arrangement further comprises at least one fixed blade nozzle proximal the central axis of the bit body, each fixed blade nozzle arranged to direct a stream of drilling fluid toward the fixed-blade cutting elements; and at least one rolling cutter nozzle spaced from the central axis of the bit body, each rolling cutter nozzle arranged to direct a stream of drilling fluid toward a rolling cutter.

According to an embodiment of the present invention, at least one of the fixed cutting elements is within approximately 0.040 inches of the central axis of the bit body.

According to an embodiment of the present invention, at least one backup cutting element is located between the leading and trailing edges of the at least one fixed blade.

According to an embodiment of the present invention, each backup cutting element is aligned with one of the fixed-blade cutting elements on the leading edge of the at least one fixed blade.

According to an embodiment of the present invention, there is a plurality of backup cutting elements arranged on a fixed blade in at least one row extending generally parallel to the leading edge of the blade and rotationally behind the cutting elements on the leading edge of the blade.

Other features and advantages of embodiments of the earth-boring bit according to the present invention will become apparent with reference to the drawings and the detailed description of the invention.

BRIEF DESCRIPTION OF THE DRAWINGS

So that the manner in which the features and advantages of the present invention, which will become apparent, are attained and can be understood in more detail, more particular description of embodiments of the invention as briefly summarized above may be had by reference to the embodiments thereof that are illustrated in the appended drawings which form a part of this specification. It is to be noted, however, that the drawings illustrate only some embodiments of the invention and therefore are not to be considered limiting of its scope as the invention may admit to other equally effective embodiments.

DETAILED DESCRIPTION OF THE INVENTION

Figure 1:
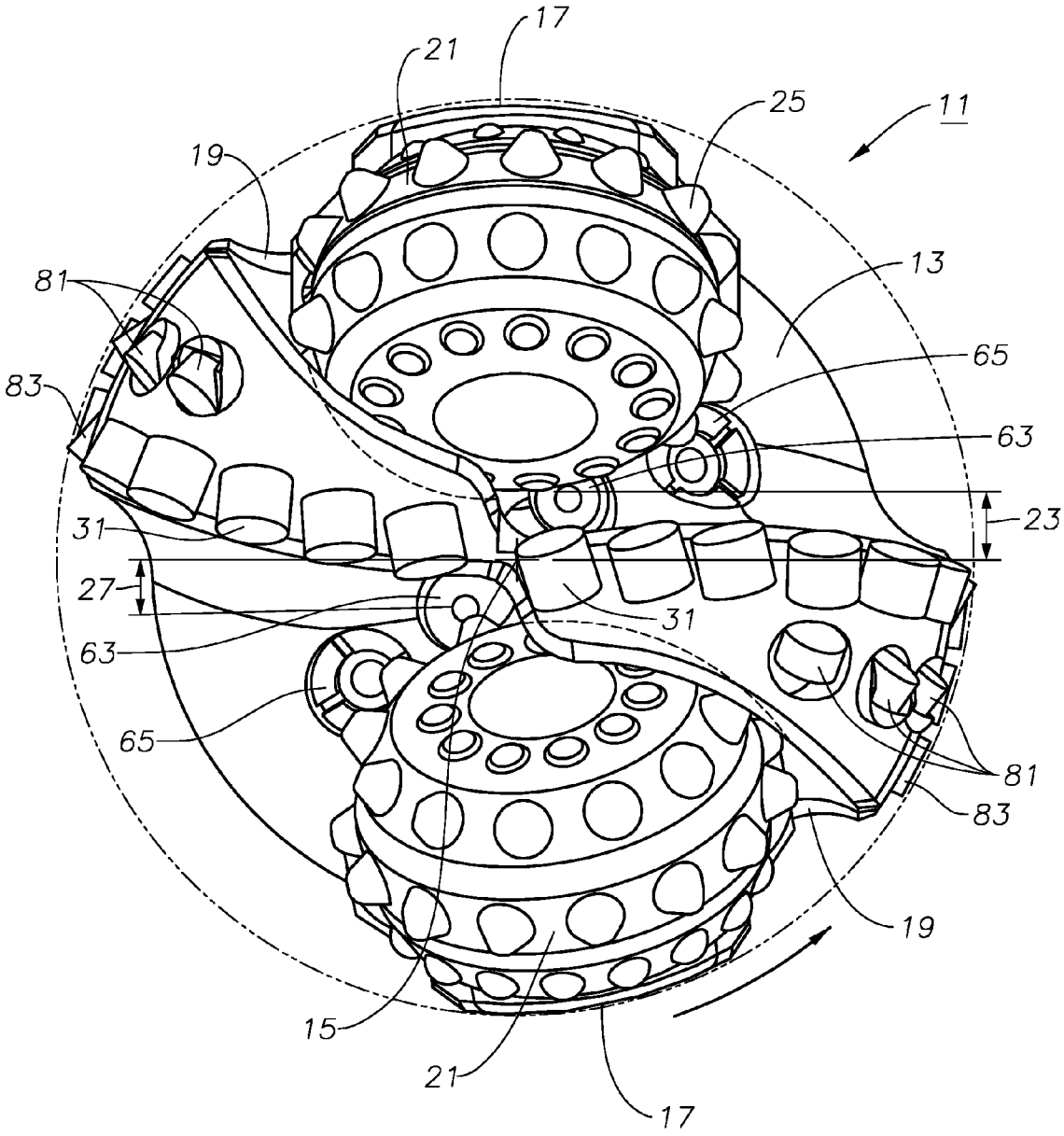
FIG. 1 is a bottom plan view of an embodiment of the hybrid earth-boring bit constructed in accordance with the present invention.

Referring to FIGS. 1-8, an earth-boring bit 11 according to an embodiment of the present invention is disclosed. Bit 11 comprises a bit body 13 having a central longitudinal axis 15 that defines an axial center of the bit body 13. In the illustrated embodiment, the bit body 13 is steel, but could also be formed of matrix material with steel reinforcements, or of a sintered carbide material. Bit body 13 includes a shank at the upper or trailing end thereof threaded or otherwise configured for attachment to a hollow drillstring (not shown), which rotates bit 11 and provides pressurized drilling fluid to the bit and the formation being drilled.

The radially outermost surface of the bit body 13 is known as the gage surface and corresponds to the gage or diameter of the borehole (shown in phantom in FIG. 1) drilled by bit 11. At least one (two are shown) bit leg 17 extends downwardly from the bit body 13 in the axial direction. The bit body 13 also has a plurality (e.g., also two shown) of fixed blades 19 that extend downwardly in the axial direction. The number of bit legs 17 and fixed blades 19 is at least one but may be more than two. In the illustrated embodiment, bit legs 17 (and the associated rolling cutters) are not directly opposite one another (are about 191 degrees apart measured in the direction of rotation of bit 11), nor are fixed blades 19 (which are about 169 degrees apart measured in the direction of rotation of bit 11). Other spacings and distributions of legs 17 and blades 19 may be appropriate.

Figure 8:
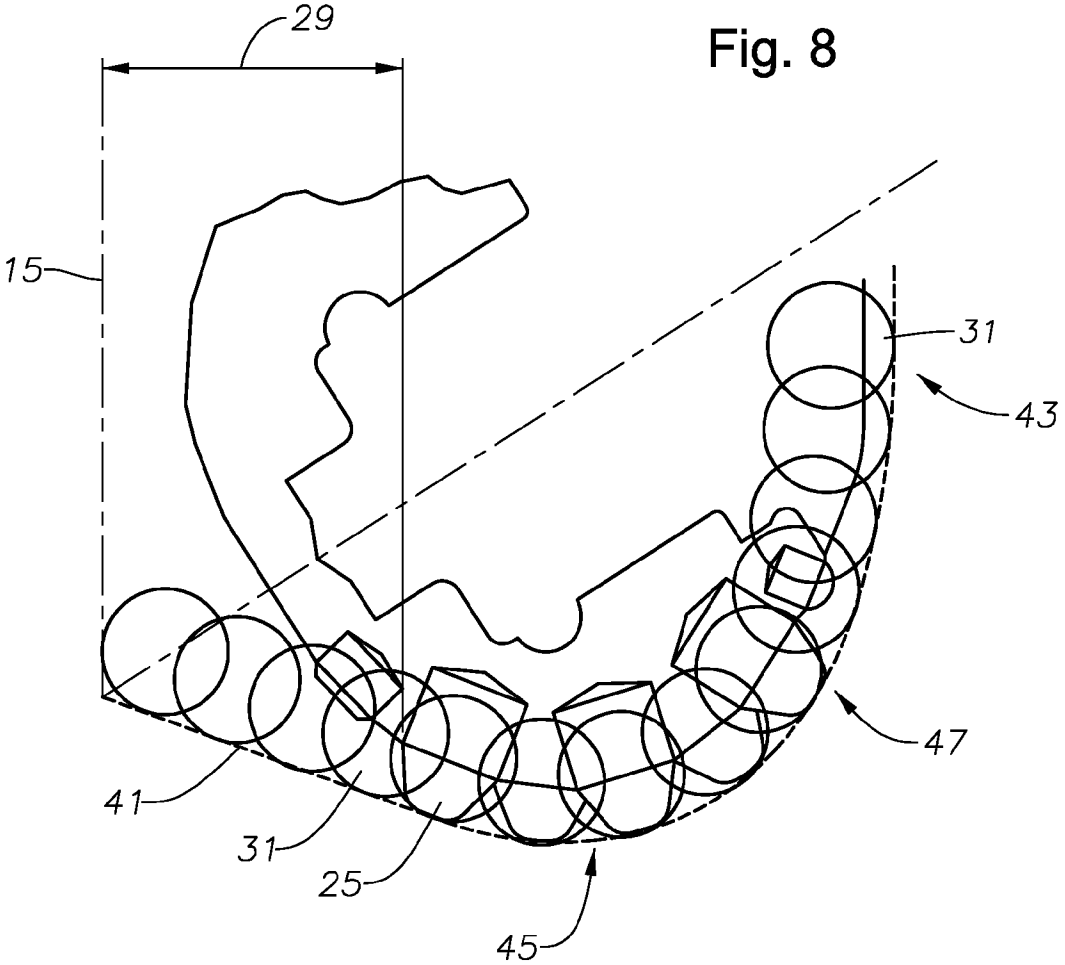
FIG. 8 is a composite view of all of the rolling-cutter cutting elements and the fixed-blade cutting elements on the embodiment of the hybrid drill bit of FIGS. 1 through 3 rotated about the central axis of the bit body and into one plane, and commonly known as a "cutting profile."

A rolling cutter 21 is mounted on a sealed journal bearing that is part of each bit leg 17. According to the illustrated embodiment, the rotational axis of each rolling cutter 21 intersects the axial center 15 of the bit. Sealed or unsealed journal or rolling-element bearings may be employed as cutter bearings. Each of the rolling cutters 21 is formed and dimensioned such that the radially innermost ends of the rolling cutters 21 are radially spaced apart from the axial center 15 (FIG. 1) by a minimal radial distance 23 of about 0.60 inch. As shown in particular in FIGS. 6 and 7, rolling cutters 21 are not conical in configuration as is typical in conventional rolling cutter bits. Further, the radially outermost surface of each rolling cutter 21 (typically called the gage cutter surface in conventional rolling cutter bits), as well as the bit legs 17, are "off gage" or spaced inward from the outermost gage surface of bit body 13. In the illustrated embodiment, rolling cutters 21 have no skew or angle and no offset, so that the axis of rotation of each rolling cutter 21 intersects the axial center (central axis) 15 of the bit body 13 (as shown in FIG. 8). Alternatively, the rolling cutters 21 may be provided with skew angle and (or) offset to induce sliding of the rolling cutters 21 as they roll over the borehole bottom.

One or more (a plurality are illustrated) rolling-cutter cutting inserts or elements 25 are arranged on the rolling cutters 21 in generally circumferential rows thereabout such that each cutting element 25 is radially spaced apart from the axial center 15 by a minimal radial distance 27 of about 0.30 inch. The minimal radial distances 23, 27 may vary according to the application and bit size, and may vary from cone to cone, and/or cutting element to cutting element, an objective being to leave removal of formation material at the center of the borehole to the fixed-blade cutting elements 31 (rather than the rolling-cutter cutting elements 25). Rolling-cutter cutting elements 25 need not be arranged in rows, but instead could be "randomly" placed on each rolling cutter 21. Moreover, the rolling-cutter cutting elements may take the form of one or more discs or "kerf-rings," which would also fall within the meaning of the term rolling-cutter cutting elements.

Tungsten carbide inserts, secured by interference fit into bores in the rolling cutter 21 are shown, but a milled- or steel-tooth cutter having hardfaced cutting elements (25) integrally formed with and protruding from the rolling cutter could be used in certain applications and the term "rolling-cutter cutting elements" as used herein encompasses such teeth. The inserts or cutting elements may be chisel-shaped as shown, conical, round, or ovoid, or other shapes and combinations of shapes depending upon the application. Rolling-cutter cutting elements 25 may also be formed of, or coated with, superabrasive or super-hard materials such as polycrystalline diamond, cubic boron nitride, and the like.

In addition, a plurality of fixed or fixed-blade cutting elements 31 are arranged in a row and secured to each of the fixed blades 19 at the leading edges thereof (leading being defined in the direction of rotation of bit 11). Each of the fixed-blade cutting elements 31 comprises a polycrystalline diamond layer or table on a rotationally leading face of a supporting substrate, the diamond layer or table providing a cutting face having a cutting edge at a periphery thereof for engaging the formation. At least a portion of at least one of the fixed cutting elements 31 is located near or at the axial center 15 of the bit body 13 and thus is positioned to remove formation material at the axial center of the borehole (typically, the axial center of the bit will generally coincide with the center of the borehole being drilled, with some minimal variation due to lateral bit movement during drilling). In a 7⅞ inch bit as illustrated, the at least one of the fixed cutting elements 31 has its laterally innermost edge tangent to the axial center of the bit 11 (as shown in FIG. 8). In any size bit, at least the innermost lateral edge of the fixed-blade cutting element 31 adjacent the axial center 15 of the bit should be within approximately 0.040 inches of the axial center 15 of the bit (and, thus, the center of the borehole being drilled).

Fixed-blade cutting elements 31 radially outward of the innermost cutting element 31 are secured along portions of the leading edge of blade 19 at positions up to and including the radially outermost or gage surface of bit body 11. In addition to fixed-blade cutting elements 31 including polycrystalline tables mounted on tungsten carbide substrates, such term as used herein encompasses thermally stable polycrystalline diamond (TSP) wafers or tables mounted on tungsten carbide substrates, and other, similar superabrasive or super-hard materials such as cubic boron nitride and diamond-like carbon. Fixed-blade cutting elements 31 may be brazed or otherwise secured in recesses or "pockets" on each blade 19 so that their peripheral or cutting edges on cutting faces are presented to the formation.

Figure 4:
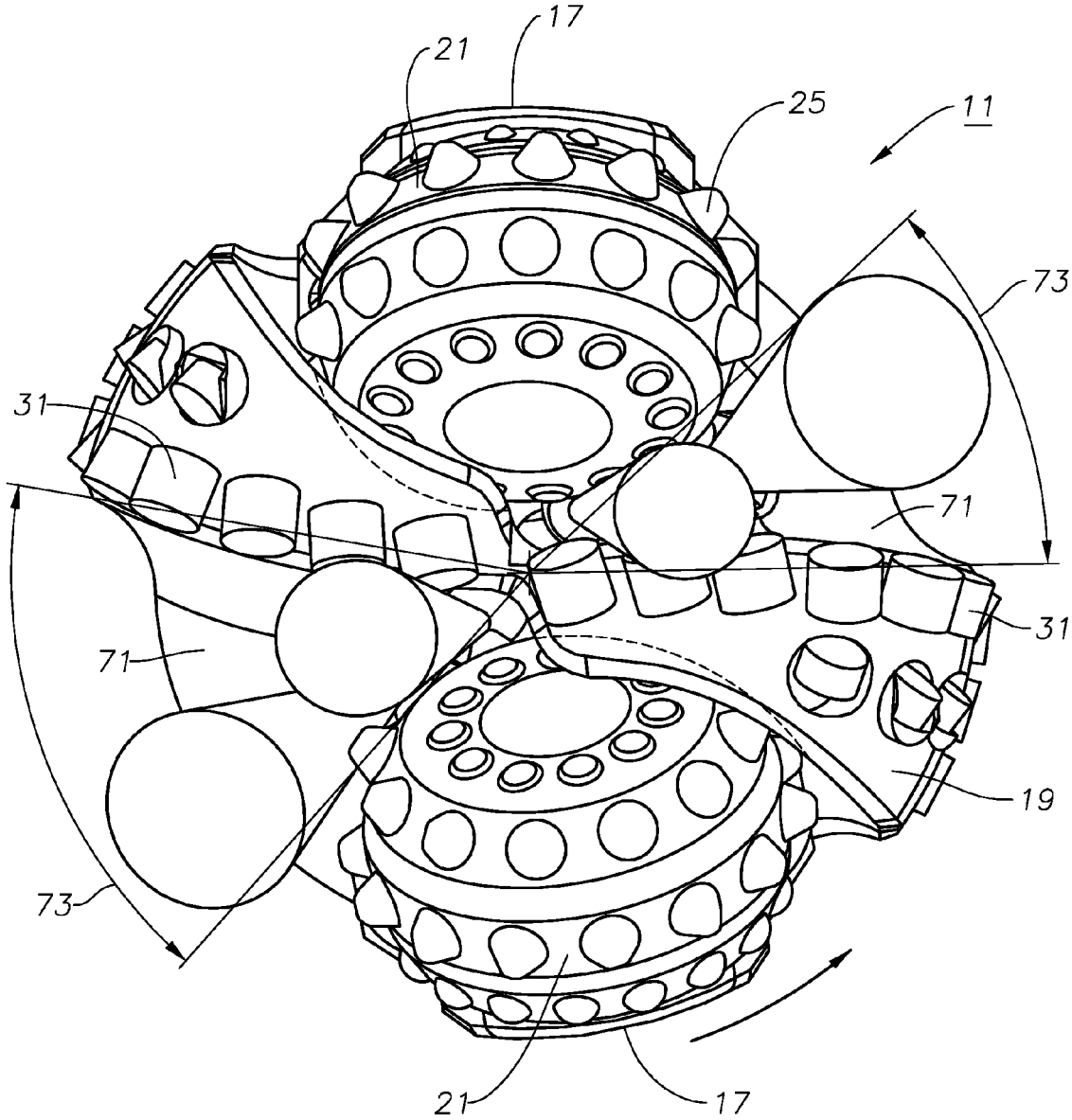
FIGS. 4 and 5 are bottom plan and side elevation views, respectively, of the embodiment of the hybrid earth-boring bit of FIGS. 1 through 3 showing streams of fluid directed from the nozzles.
Figure 5:
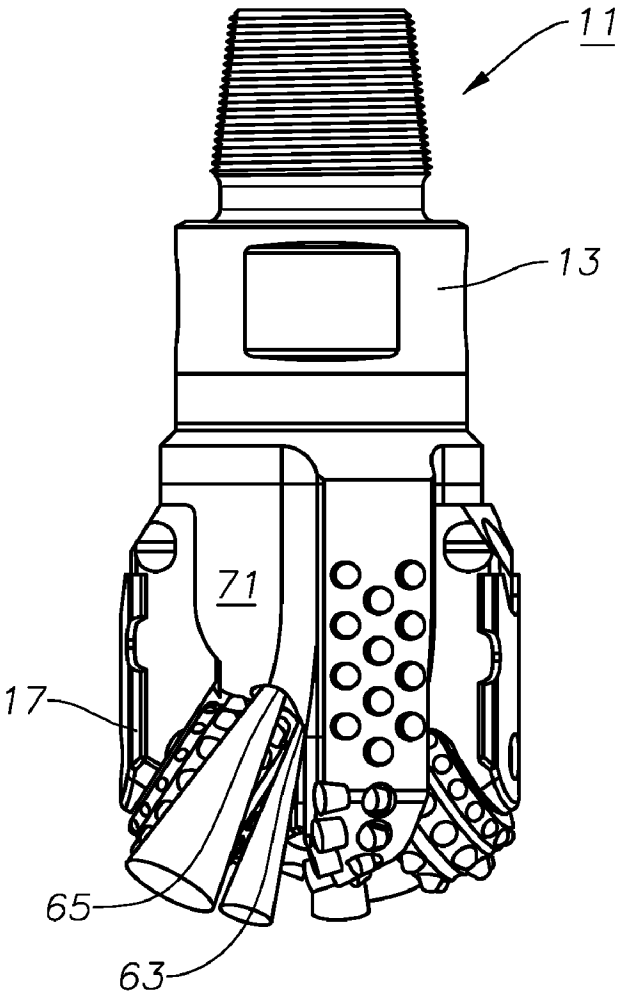

Four nozzles 63, 65 are generally centrally located in receptacles in the bit body 13. A pair of fixed blade nozzles 63 is located close or proximal to the axial center 15 of the bit 11. Fixed blade nozzles 63 are located and configured to direct a stream of drilling fluid from the interior of the bit to a location at least proximate (preferably forward of to avoid unnecessary wear on elements 31 and the material surrounding and retaining them) at least a portion of the leading edge of each fixed blade 19 and the fixed-blade cutting elements 31 carried thereon (FIGS. 4 and 5). Another pair of rolling cutter nozzles 65 are spaced-apart from the central axis 15 of the bit boy 13 (radially outward of fixed blade nozzles 63) and are located and configured to direct a stream of drilling fluid to a location at least proximate the trailing side of each rolling cutter 21 and rolling-cutter cutting elements 25 (FIGS. 4 and 5). The streams of drilling fluid cool the cutting elements and remove cuttings from blades 19 and rolling cutters 21 and their associated cutting elements 25, 31. Nozzles 63, 65 may be conventional cylinders of tungsten carbide or similar hard metal that have circular apertures of selected dimension. Nozzles 63, 65 are threaded to retain them in their respective receptacles. Nozzles 63, 65 may also take the form of "ports" that are integrally formed at the desired location and with the correct dimension in the bit body 13.

In connection with the nozzles, a pair of junk slots 71 are provided between the trailing side of each rolling cutter 21, and the leading edge of each fixed blade 19 (leading and trailing again are defined with reference to the direction of rotation of the bit 11). Junk slots 71 provide a generally unobstructed area or volume for clearance of cuttings and drilling fluid from the central portion of the bit 11 to its periphery for return of these materials to the surface. As shown in FIGS. 2, 4 and 5, junk slots 71 are defined between the bit body 13 and the space between the trailing side of each cutter 21 and the leading edge of each blade 19. The volume of the junk slot exceeds the open volume of other areas of the bit, particularly in the angular dimension 73 of the slot, which is much larger than the angular dimension (and volume defined) between the trailing edge of each blade 19 and the leading edge of each rolling cutter 21. The increased volume of junk slots 71 is partially accomplished by providing a recess in the trailing side of each fixed blade 19 (see FIG. 1) so that the rolling cutters 21 can be positioned closer to the trailing side of each fixed blade than would be permitted without the clearance provided by the recess.

Also provided on each fixed blade 19, between the leading and trailing edges, are a plurality of backup cutters or cutting elements 81 arranged in a row that is generally parallel to the leading edge of the blade 19. Backup cutters 81 are similar in configuration to fixed blade cutters or cutting elements 31, but may be smaller in diameter or more recessed in a blade 19 to provide a reduced exposure above the blade surface than the exposure of the primary fixed-blade cutting elements 31 on the leading blade edges. Alternatively, backup cutters 81 may comprise BRUTE™ cutting elements as offered by the assignee of the present invention through its Hughes Christensen operating unit, such cutters and their use being disclosed in U.S. Pat. No. 6,408,958. As another alternative, rather than being active cutting elements similar to fixed blade cutters 31, backup cutters 81 could be passive elements, such as round or ovoid tungsten carbide or superabrasive elements that have no cutting edge (although still referred to as backup cutters or cutting elements). Such passive elements would serve to protect the lower surface of each blade 19 from wear.

Preferably, backup cutters 81 are radially spaced along the blade 19 to concentrate their effect in the nose, shoulder, and gage areas (as described below in connection with FIG. 8). Backup cutters 81 can be arranged on blades 19 to be radially "aligned" with fixed blade cutters 31 so that the backup cutters 81 cut in the same groove or kerf made by the fixed blade cutters 31 on the same blade 19. Alternatively, backup cutters 81 can be arranged to be radially offset from the fixed blade cutters 31 on the same blade 19, so that they cut between the grooves made by cutters 31. Backup cutters 81 add cutting elements to the cutting profile (FIG. 1) and increase cutter "coverage" in terms of redundancy at each radial position on the bottom of the borehole. Whether active cutting elements as illustrated or passive elements, backup cutters 81 can help reduce wear of and damage to cutting elements 31, and well as reduce the potential for damage to or wear of fixed blades 19. Additionally, backup cutters 81 create additional points of engagement between bit 11 and the formation being drilled. This enhances bit stability, for example making the two-fixed-blade configuration illustrated exhibit stability characteristics similar to a four-bladed fixed-cutter bit.

Figure 2:
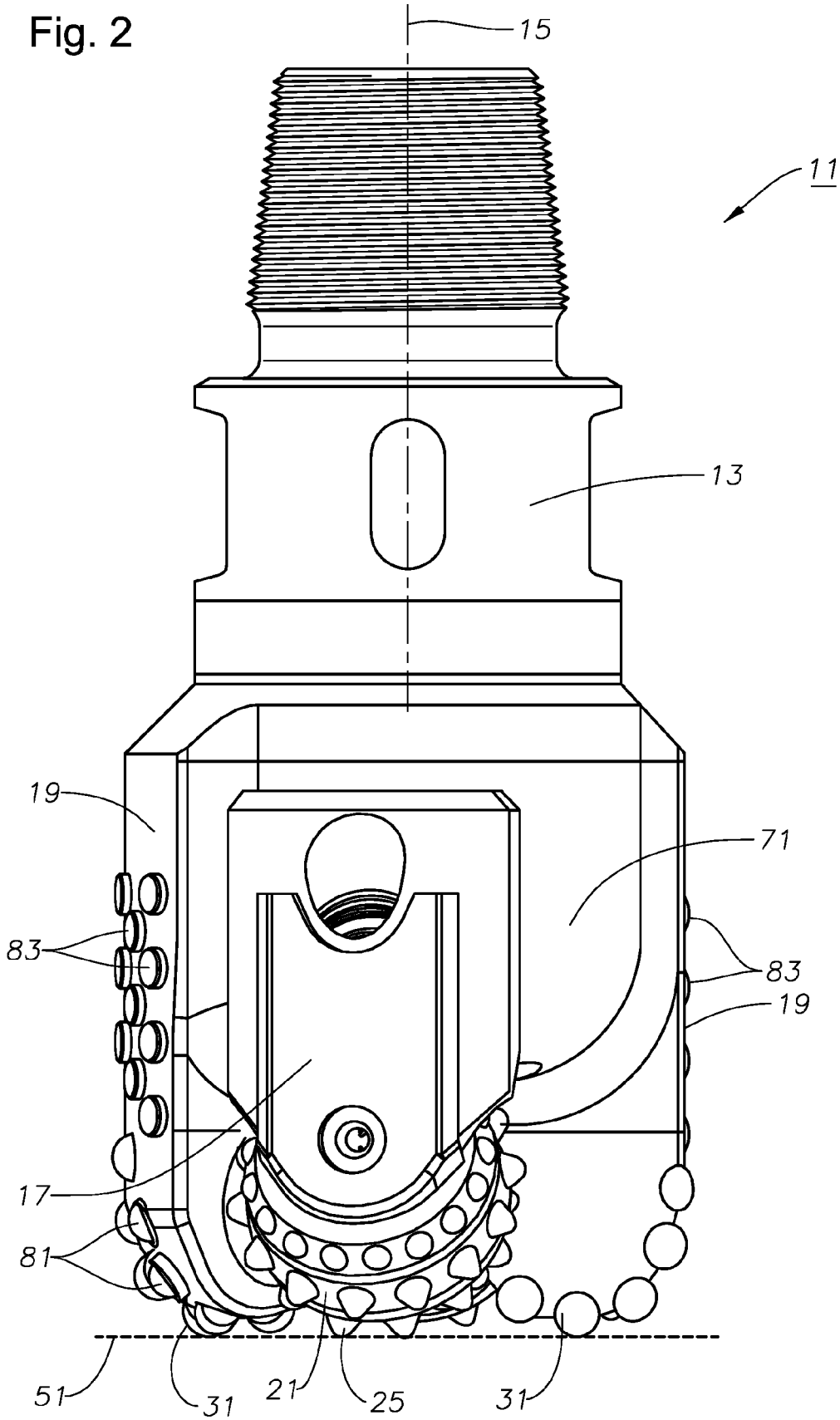
FIG. 2 is a side elevation view of the embodiment of the hybrid earth-boring bit of FIG. 1 constructed in accordance with the present invention.
Figure 3:
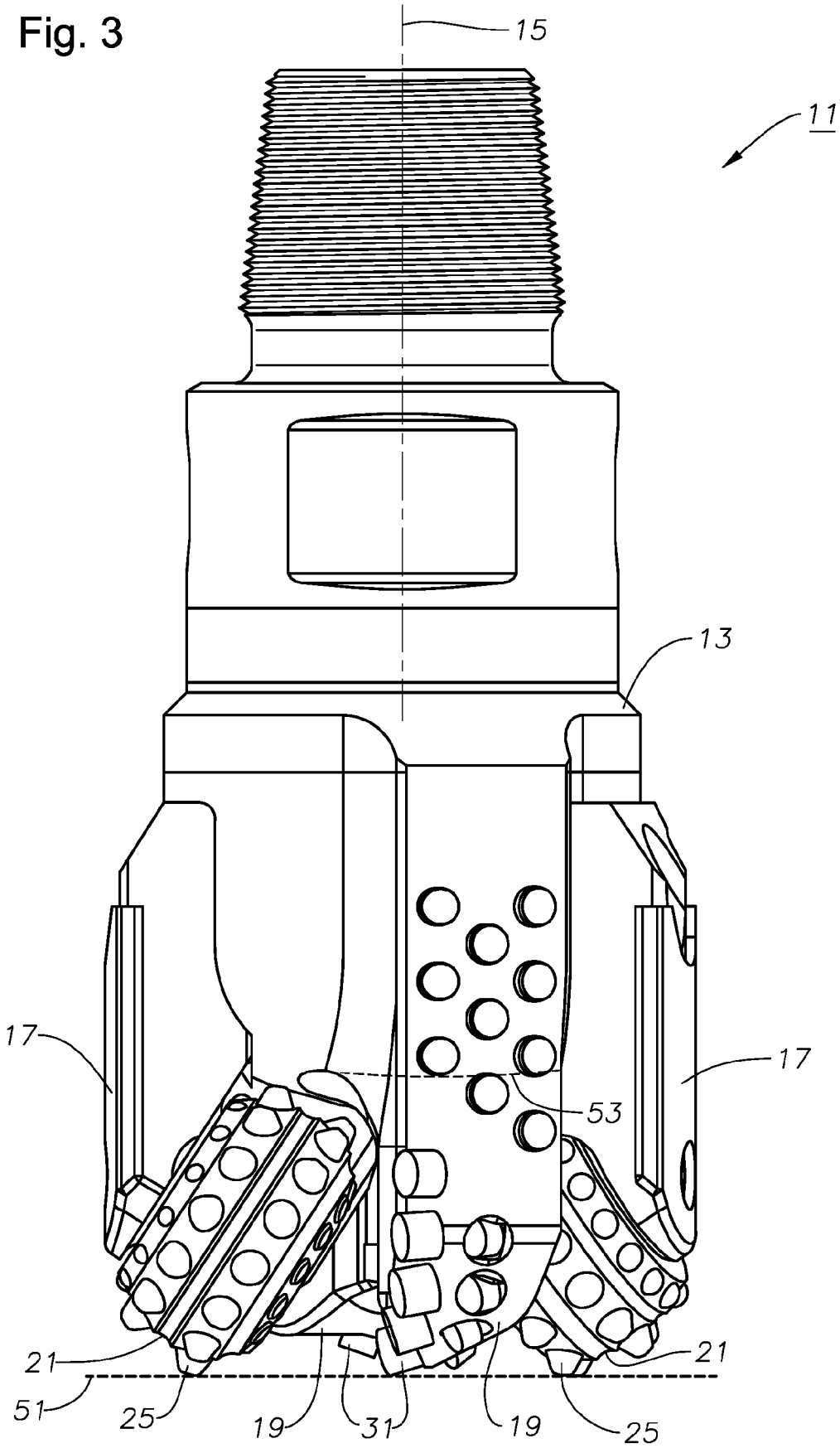
FIG. 3 is a side elevation view of the hybrid earth-boring bit of FIG. 1 constructed in accordance with the present invention.

In addition to backup cutters 81, a plurality of wear-resistant elements 83 are present on the gage surface at the outermost periphery of each blade 19 (FIGS. 1 and 2). These elements 83 may be flat-topped or round-topped tungsten-carbide or other hard-metal inserts interference fit into apertures on the gage surface of each blade 19. The primary function of these elements 83 is passive and is to resist wear of the blade 19. In some applications, it may be desirable to place active cutting elements on the bit leg, such as super-hard (polycrystalline diamond) flat-topped elements with a beveled edge for shear-cutting the sidewall of the borehole being drilled.

Figure 6:
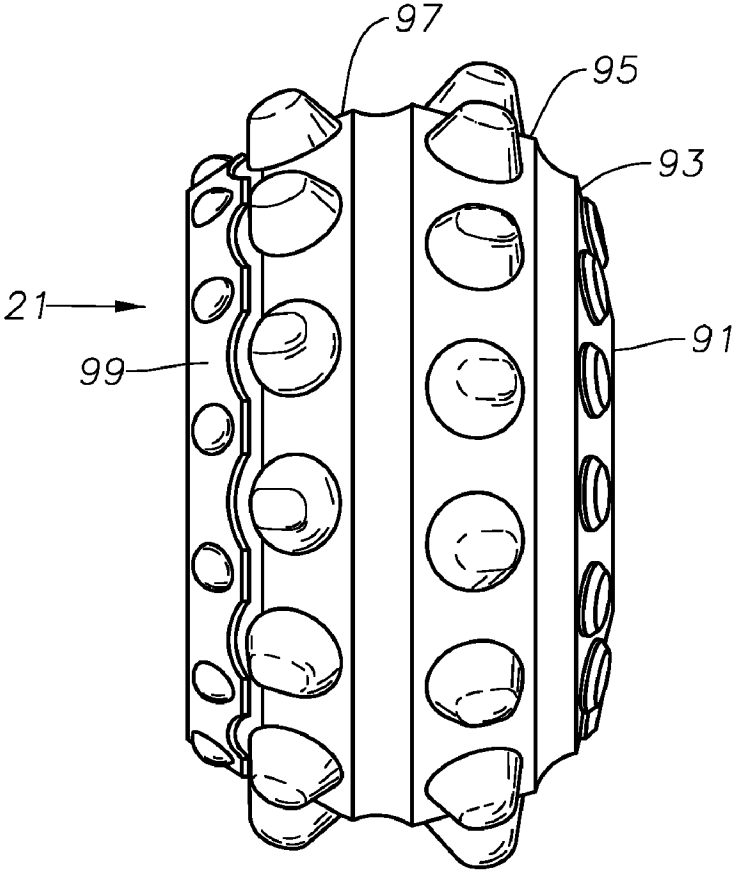
FIGS. 6 and 7 are side elevation views of the rolling cutters employed in the embodiment of the hybrid earth-boring bit of FIGS. 1 through 3.
Figure 7:
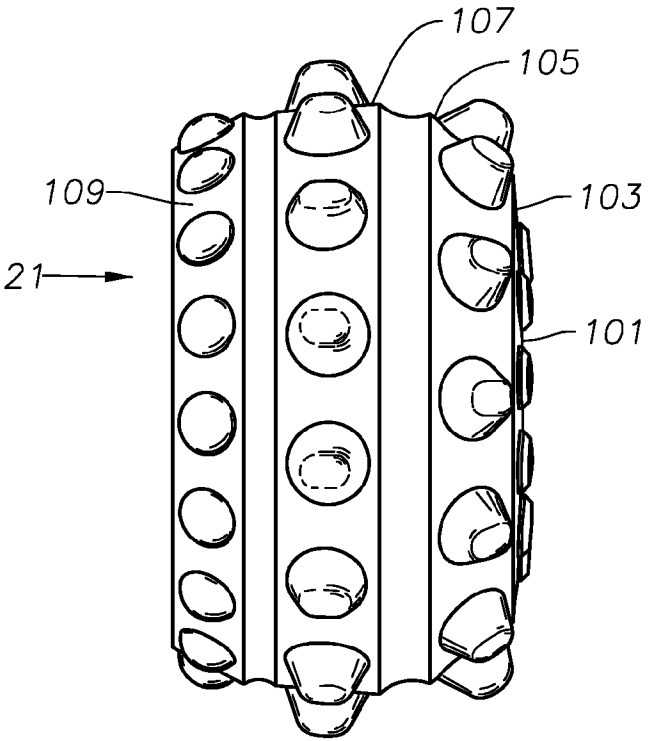

FIGS. 6 and 7 illustrate each of the rolling cutters 21, which are of different configuration from one another, and neither is generally conical, as is typical of rolling cutters used in rolling-cutter-type bits. Cutter 91 of FIG. 6 has four surfaces or lands on which cutting elements or inserts are located. A nose or innermost surface 93 is covered with flat-topped, wear-resistant inserts or cutting elements. A second surface 95 is conical and of larger diameter than the first 91, and has chisel-shaped cutting elements on it. A third surface 97 is conical and of smaller diameter than the second surface 95 and again has chisel-shaped inserts. A fourth surface 99 is conical and of smaller diameter than the second 95 and third 97 surfaces, but is larger than the first 93. Fourth surface 99 has round-topped inserts or cutting elements that are intended primarily to resist wear.

Cutter 101 of FIG. 7 also has four surfaces or lands on which cutting elements are located. A nose or first surface 103 has flat-topped, wear-resistant cutting elements on it. A second surface 105 is conical and of larger diameter than the first surface 103. Second surface 105 has chisel-shaped cutting elements on it. A third surface 107 is generally cylindrical and of larger diameter than second surface 105. Again, chisel-shaped cutting elements are on the third surface 107. A fourth surface 109 is conical and of smaller diameter than third surface 107. Round-topped wear-resistant inserts are placed on fourth surface 109.

FIG. 8 is a schematic superimposition of the cutter and fixed cutting elements 25, 31 on each of the cutters and blades obtained by rotating the elements about the central axis 15 into a single plane. FIG. 8 is known as a "cutting profile." As shown in FIG. 8, the rolling-cutter cutting elements 25 and the fixed-blade cutting elements 31 combine to define a cutting profile 41 that extends from the axial center 15 through a "cone region," a "nose region," and a "shoulder region" (see FIG. 9) to a radially outermost perimeter or gage surface 43 with respect to the axis (backup cutters 81 are not shown for clarity). In the illustrated embodiment, only the fixed-blade cutting elements 31 form the cutting profile 41 at the axial center 15 and the gage surface 43. However, the rolling-cutter cutting elements 25 overlap or combine with the fixed-blade cutting elements 31 on the cutting profile 41 to produce substantially congruent surfaces or kerfs in the formation being drilled between the cone region near the axial center 15 and the gage region at the gage of the borehole 43. The rolling-cutter cutting elements 25 thus are configured to cut at the nose 45 and shoulder 47 of the cutting profile 41, where the nose 45 is the axially leading part of the profile (i.e., located between the axial center 15 and the shoulder 47) facing the borehole wall and located adjacent the gage surface 43. In this context, "shoulder" is used to describe the transition between the nose region 45 and the gage region and the cutting profile.

Figure 9:
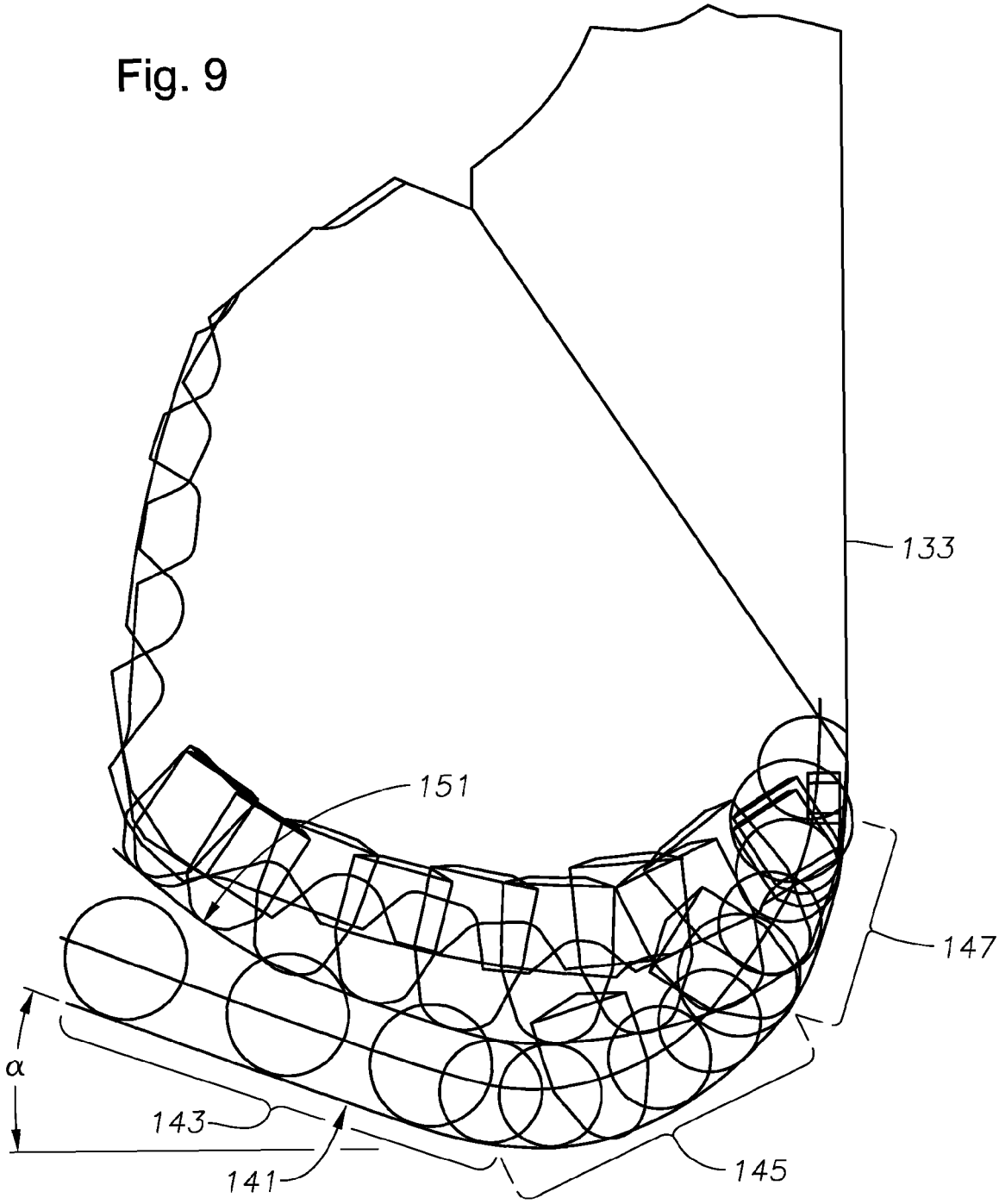
FIG. 9 is a superimposition of the cutting profile of FIG. 8 onto a cutting profile of a typical rolling-cutter earth-boring bit.

FIG. 9 is a superimposition of the cutting profile of FIG. 8 (noted by curved line 141) with a representative profile generated by a similarly sized (7⅞ inch) three-cone rolling cutter bit (noted by the curved line 151). The two profiles are aligned at gage 133, that is, the radially outermost surfaces of each bit are aligned for comparison. The profile of the hybrid bit according to the present invention divides into three regions, as alluded to previously: a generally linear cone region 143 extending from the axial center radially outward; a nose region 141 that is curved at a selected radius and defines the leading portion of the bit; and a shoulder region 147 that is also curved at a selected radius and is connects the nose region to the gage of the bit 133. The cone region 141 describes an angle $\alpha$ with the horizontal bottom of the borehole of between about 10 and 30 degrees, preferably about 20 degrees. The selected radii in the nose 145 and shoulder 147 regions may be the same (a single radius) or different (a compound radius). In either case, the profile curve of the hybrid bit is tangent to gage 133 at the point at which it intersects the gage. As can be seen, the rolling cutter profile 151 defines a generally sweeping curve (typically of multiple compound radii) that extends from the axial center to the gage and is not tangent to gage 133 where it intersects gage. The curve described by the profile of the hybrid bit according to the present invention thus more resembles that of a typical modern fixed-cutter diamond bit than that of a rolling-cutter bit.

As illustrated and previously mentioned, the radially innermost fixed-blade cutting element 31 preferably is substantially tangent to the axial center 15 of the bit 11. The radially innermost lateral or peripheral portion of the innermost fixed cutting element should preferably be no more than 0.040 inch from the axial center 15. The radially innermost rolling-cutter cutting element 25 (other than the cutter nose elements, which do not actively engage the formation), is spaced apart a distance 29 of about 2.28 inch from the axial center 15 of the bit for the 7⅞ inch bit illustrated.

Thus, the rolling-cutter cutting elements 25 and the fixed-blade cutting elements 31 combine to define a congruent cutting face in the nose 45 and shoulder 47 (FIG. 8), which are known to be the most difficult to drill portions of a borehole. The nose or leading part of the profile is particularly highly loaded when drilling through transitions from soft to hard rock when the entire bit load can be concentrated on this small portion of the borehole. The shoulder, on the other hand, absorbs the lateral forces, which can be extremely high during dynamic events such as bit whirl, and stick-slip. In the nose and shoulder area, the cutting speed is the highest and more than half the cuttings volume is generated in this region. The rolling-cutter cutting elements 25 crush and pre- or partially fracture formation in the highly stressed nose and shoulder sections, easing the burden on fixed blade cutter elements 31.

A reference plane 51 (FIGS. 2 and 3) is located at the leading or distalmost axial end of the hybrid drill bit 11. At least one of each of the rolling-cutter cutting elements 25 and the fixed cutting elements 31 extend in the axial direction at the reference plane 51 at a substantially equal dimension, but are radially offset from each other. However, such alignment in a common plane 51 perpendicular to the central axis 15 between the distalmost elements rolling and fixed cutter cutting elements 25, 31 is not required such that elements 25, 31 may be axially spaced apart (or project a different distance) by a significant distance (0.125 inch) when in their distalmost position. The fixed-blade cutting elements 31 are axially spaced apart from and distal from (e.g., lower than) the bit body 13.

In another embodiment, rolling-cutter cutting elements 25 may extend beyond (e.g., by approximately 0.060-0.125 inch) the distal-most position of the fixed blades 19 and fixed-blade cutting elements 31 to compensate for the difference in wear between those components. As the profile 41 transitions from the shoulder 47 to the gage 43 of the hybrid bit 11, the rolling-cutter elements 25 no longer engage the formation (see FIG. 8), and multiple rows of vertically-staggered (i.e., axially) fixed-blade cutting elements 31 ream out a smooth borehole wall. Rolling-cutter cutting elements 25 are much less efficient in reaming at the gage and can cause undesirable borehole wall damage. Indeed, both the portion of each bit leg 17 above the rolling cutter and the rolling cutters 21 themselves are radially spaced-apart from the sidewall of the borehole so that contact between rolling-cutter cutting elements 25 and the sidewall of the borehole is minimized or eliminated entirely.

The invention has several advantages and includes providing a hybrid drill bit that cuts at the center of the hole solely with fixed cutting elements and not with rolling cutters. The fixed-blade cutting elements are highly efficient at cutting the center of the hole. Moreover, due to the relatively low cutting velocity of the fixed-blade cutting elements in the center due to their proximity to the central axis of the bit body, the polycrystalline diamond compact or other superabrasive cutting elements are subject to little or no wear. The rolling cutters and their cutting elements are configured to cut a nearly congruent surface (with the cutting elements on the fixed blade) and thereby enhance the cutting action of the blades in the most difficult to drill nose and shoulder areas, which are the leading profile section (axially speaking) and thus are subjected to high wear and vibration damage in harder, more abrasive formations. The crushing action of the tungsten carbide rolling cutter inserts drives deep fractures into the hard rock, which greatly reduces its strength. The pre- or partially fractured rock is easier to remove and causes less damage and wear to the fixed-blade cutting elements than pristine formation material commonly drilled by conventional diamond or PDC cutting element-equipped drag bits. The perimeter or gage of the borehole is generated with multiple, vertically-staggered rows of fixed-blade cutting elements. This leaves a smooth borehole wall and reduces the sliding and wear on the less wear-resistant rolling cutter inserts.

While the invention has been shown or described in only some of its forms, it should be apparent to those skilled in the art that it is not so limited, but is susceptible to various changes without departing from the scope of the invention as hereinafter claimed, and legal equivalents thereof.

We claim:

1. An earth-boring bit comprising:

a bit body configured at its upper extent for connection into a drillstring, the bit body having a central axis and a radially outermost gage surface;

at least one fixed blade extending downward from the bit body in the axial direction, the at least one fixed blade having a leading edge and a trailing edge;

at least one rolling cutter mounted for rotation on the bit body, the at least one rolling cutter having a leading side and a trailing side, and wherein the at least one rolling cutter is next to and leading the at least one fixed blade with respect to a direction of rotation of the bit;

at least one nozzle mounted in the bit body proximal the central axis, the at least one nozzle arranged to direct a stream of pressurized drilling fluid between the leading edge of the at least one fixed blade and the trailing side of the at least one rolling cutter;

a plurality of rolling-cutter cutting elements arranged on the at least one rolling cutter and radially spaced apart from the central axis of the bit body;

a plurality of fixed-blade cutting elements arranged on the leading edge of the at least one fixed blade, at least one of the plurality of fixed-blade cutting elements being located proximal the central axis of the bit body; and a junk slot formed between the trailing side of the at least one rolling cutter, the leading edge of the at least one fixed blade, and a portion of the bit body, the junk slot providing an area for removal of disintegrated formation material, the junk slot being equal to or larger in at least an angular dimension than a space between the leading side of the at least one rolling cutter and a trailing edge of a next leading fixed blade with respect to the direction of rotation of the bit.

2. The earth-boring bit of claim 1, wherein the plurality of rolling-cutter cutting elements and the plurality of fixed-blade cutting elements combine to define a cutting profile that extends from substantially the central axis to the gage surface of the bit body, the plurality of fixed-blade cutting elements forming a substantial portion of the cutting profile at the central axis and the gage surface, and the plurality of rolling-cutter cutting elements at least partially overlapping the plurality of fixed-blade cutting elements between the axial center and the gage surface.

3. The earth-boring bit of claim 1, wherein the at least one nozzle further comprises:

at least one fixed blade nozzle proximal the central axis of the bit body, the at least one fixed blade nozzle arranged to direct a stream of drilling fluid toward the plurality of fixed-blade cutting elements on the at least one fixed blade; and at least one rolling cutter nozzle spaced from the central axis of the bit body, the at least one rolling cutter nozzle arranged to direct a stream of drilling fluid toward the at least one rolling cutter.

4. The earth-boring bit of claim 1, wherein at least one of the plurality of fixed-blade cutting elements is within approximately 0.040 inches of the central axis.

5. The earth-boring bit according to claim 1, wherein the leading side of the at least one rolling cutter is at least partially in front of the trailing edge of the next leading fixed blade with respect to the direction of rotation of the bit.

6. The earth-boring bit of claim 1, wherein the at least one rolling cutter is a truncated rolling cutter.

7. An earth-boring bit comprising:

a bit body configured at its upper extent for connection into a drillstring, the bit body having a central axis and a radially outermost gage surface;

at least one fixed blade extending downward from the bit body in the axial direction, the at least one fixed blade having a leading edge and a trailing edge;

at least one rolling cutter mounted for rotation on the bit body, the at least one rolling cutter having a leading side and a trailing side, and wherein the at least one rolling cutter is next to and leading the at least one fixed blade with respect to a direction of rotation of the bit;

at least one nozzle mounted in the bit body and arranged to direct a stream of pressurized drilling fluid from the drillstring toward at least one of the at least one rolling cutter and the at least one fixed blade;

a plurality of rolling-cutter cutting elements arranged on the at least one rolling cutter and radially spaced apart from the central axis of the bit body;

a plurality of fixed-blade cutting elements arranged on the leading edge of the at least one fixed blade, at least one of the fixed-blade cutting elements being located proximal the central axis of the bit body; and at least one junk slot formed between the trailing side of the at least one rolling cutter, the leading edge of the at least one fixed blade, and a portion of the bit body, the junk slot providing an area for removal of formation material generated by the bit, the junk slot being equal to or larger in at least an angular dimension than a space between the leading side of the at least one rolling cutter and a trailing edge of a next leading fixed blade with respect to the direction of rotation of the bit.

8. The earth-boring bit of claim 7, wherein the at least one nozzle further comprises:

at least one fixed blade nozzle proximal the central axis of the bit body, the at least one fixed blade nozzle arranged to direct a stream of drilling fluid toward at least one of the plurality of fixed-blade cutting elements on the at least one fixed blade; and at least one rolling cutter nozzle spaced from the central axis of the bit body, the at least one rolling-cutter nozzle arranged to direct a stream of drilling fluid toward the at least one rolling cutter.

9. The earth-boring bit of claim 7, wherein at least one of the plurality of fixed-blade cutting elements is within approximately 0.040 inches of the central axis of the bit body.

10. The earth-boring bit of claim 7, wherein the plurality of rolling-cutter cutting elements and the plurality of fixed-blade cutting elements combine to define a cutting profile that extends from substantially the central axis to the gage surface of the bit body, the plurality of fixed-blade cutting elements forming a substantial portion of the cutting profile at the central axis and the gage surface, and the plurality of rolling-cutter cutting elements at least partially overlapping the plurality of fixed-blade cutting elements between the central axis and the gage surface.

11. An earth-boring bit comprising:

a bit body configured at its upper extent for connection into a drillstring, the bit body having a central axis and a radially outermost gage surface;

at least one fixed blade extending downward from the bit body in the axial direction, the at least one fixed blade having leading and trailing edges;

at least one rolling cutter mounted for rotation on the bit body, the at least one rolling cutter having leading and trailing sides, and wherein the at least one rolling cutter is next to and leading the at least one fixed blade with respect to a direction of rotation of the bit;

at least one fixed blade nozzle proximal the central axis of the bit body, the at least one fixed blade nozzle arranged to direct a stream of drilling fluid toward the at least one fixed blade;

at least one rolling cutter nozzle spaced from the central axis of the bit body, the at least one rolling cutter nozzle arranged to direct a stream of drilling fluid toward the at least one rolling cutter;

a plurality of rolling-cutter cutting elements arranged on the rolling cutter and radially spaced apart from the central axis of the bit body;

a plurality of fixed-blade cutting elements arranged on the leading edge of the at least one fixed blade, at least one of the plurality of fixed-blade cutting elements being located proximal the central axis of the bit body to remove formation material at the axial center of the bit; and at least one junk slot formed between the trailing side of the at least one rolling cutter, the leading edge of the at least one blade, and a portion of the bit body, the at least one junk slot providing an area for removal of formation material, the at least one junk slot being equal to or larger in at least an angular dimension than a space between the leading side of the at least one rolling cutter and a trailing edge a next leading fixed blade with respect to the direction of rotation of the bit.

12. The earth-boring bit of claim 11, wherein the plurality of rolling-cutter cutting elements and the plurality of fixed-blade cutting elements combine to define a cutting profile that extends from substantially the central axis to the gage surface of the bit body, the plurality of fixed-blade cutting elements forming a substantial portion of the cutting profile at the central axis and the gage surface, and the plurality of rolling-cutter cutting elements at least partially overlapping the plurality of fixed-blade cutting elements between the central axis and the gage surface.

13. An earth-boring bit comprising:

a bit body with a means at its upper extent for connection into a drillstring, the bit body having a central axis and a radially outermost gage surface;

at least one fixed blade extending downward from the bit body in the axial direction, the at least one fixed blade having a leading and a trailing edge;

at least one rolling cutter mounted for rotation on the bit body;

a plurality of rolling-cutter cutting elements arranged on the at least one rolling cutter and radially spaced apart from the central axis of the bit body;

a plurality of fixed-blade cutting elements arranged on the leading edge of the at least one fixed blade, at least one of the plurality of fixed-blade cutting elements being located proximal the central axis of the bit body;

at least one backup cutting element located between the leading and trailing edges of the at least one fixed blade and rotationally behind at least a portion of one of the plurality of fixed-blade cutting elements arranged on the leading edge; and wherein the plurality of rolling-cutter cutting elements, the plurality of fixed-blade cutting elements, and the at least one backup cutting element combine to define a cutting profile that extends from substantially the central axis to the gage surface of the bit body, the profile having a cone region defining a selected angle relative to horizontal and a curve connecting the cone region to a gage region that is aligned with the gage surface of the bit body, the curve being tangent to the gage surface of the bit body.

14. The earth-boring bit of claim 13, wherein the at least one backup cutting element is radially aligned with one of the plurality of fixed-blade cutting elements on the leading edge of the at least one fixed blade.

15. The earth-boring bit of claim 13, wherein at least one of the plurality of fixed-blade cutting elements is within approximately 0.040 inches of the axial center.

16. The earth-boring bit of claim 13, wherein the at least one backup cutting element comprises a plurality of backup cutting elements arranged in at least one row extending generally parallel to the leading edge of the at least one fixed blade.

17. The earth-boring bit of claim 13, wherein the plurality of fixed-blade cutting elements form substantially all of the cutting profile at the central axis and the gage surface, and the plurality of rolling-cutter cutting elements at least partially overlap the plurality of fixed-blade cutting elements between the central axis and the gage surface.

18. The earth-boring bit according to claim 13, wherein the at least one rolling cutter has a leading side and is next to and leading the at least one fixed blade with respect to a direction of rotation of the bit, and wherein the leading side of the at least one rolling cutter is at least partially in front of a trailing edge of a next leading fixed blade with respect to the direction of rotation of the bit.

19. An earth-boring bit comprising:

a bit body configured at its upper extent for connection into a drillstring, the bit body having a central axis and a radially outermost gage surface;

at least one fixed blade extending downward from the bit body in the axial direction, the at least one fixed blade having a leading and a trailing edge;

at least one rolling cutter mounted for rotation on the bit body;

a plurality of rolling-cutter cutting elements arranged on the at least one rolling cutter and radially spaced apart from the central axis of the bit body;

a plurality of fixed-blade cutting elements arranged on the at least one fixed blade, at least one of the plurality of fixed-blade cutting elements being located proximal the central axis of the bit body, another of the plurality of fixed-blade cutting elements being located proximal the gage surface of the bit body;

a plurality of backup cutting elements, each backup cutting element being located between the leading and trailing edges of the at least one fixed blade; and wherein the plurality of rolling-cutter cutting elements, the plurality of fixed-blade cutting elements, and the plurality of backup cutting elements combine to define a cutting profile that extends from substantially the central axis to the gage surface of the bit body, the profile having a cone region defining a selected angle relative to horizontal and a curve connecting the cone region to a gage region that is aligned with the gage surface of the bit body, the curve being tangent to the gage surface of the bit body.

20. The earth-boring bit of claim 19, wherein each of the plurality of backup cutting elements is radially aligned with one of the plurality of fixed-blade cutting elements on the leading edge of the at least one fixed blade.

21. The earth-boring bit of claim 19, wherein at least one of the plurality of fixed-blade cutting elements is within approximately 0.040 inches of the central axis of the bit body.

22. The earth-boring bit of claim 19, further comprising a plurality of backup cutting elements arranged in at least one row extending generally parallel to the leading edge of the at least one fixed blade.

23. The earth-boring bit of claim 19, wherein the plurality of fixed-blade cutting elements form substantially all of the cutting profile at the central axis and the gage surface, and the plurality of rolling-cutter cutting elements at least partially overlap the plurality of fixed-blade cutting elements between the central axis and the gage surface.

24. An earth-boring bit comprising:

a bit body configured at its upper extent for connection into a drillstring, the bit body having a central axis and a radially outermost gage surface;

at least one fixed blade extending downward from the bit body in the axial direction, the at least one fixed blade having a leading and a trailing edge;

at least one rolling cutter mounted for rotation on the bit body;

a plurality of rolling-cutter cutting elements arranged on the at least one rolling cutter and radially spaced apart from the central axis of the bit body; and a plurality of fixed-blade cutting elements arranged on the at least one fixed blade, at least one of the plurality of fixed-blade cutting elements being located proximal the central axis of the bit body, another of the plurality of fixed-blade cutting elements being located proximal the gage surface of the bit body, wherein the plurality of rolling-cutter cutting elements and the plurality of fixed-blade cutting elements combine to define a cutting profile that extends from substantially the central axis to the gage surface of the bit body, the profile having a cone region defining a selected angle relative to horizontal and a curve connecting the cone region to a gage region that is aligned with the gage surface of the bit body, the curve being tangent to the gage surface of the bit body.

25. The earth-boring bit according to claim 24, wherein the curve has a single radius.

26. An earth-boring bit comprising:

a bit body configured at its upper extent for connection into a drillstring, the bit body having a central axis and a radially outermost gage surface;

at least one fixed blade extending downward from the bit body in the axial direction, the at least one fixed blade having a leading and a trailing edge;

at least one rolling cutter mounted for rotation on the bit body;

a plurality of rolling-cutter cutting elements arranged on the at least one rolling cutter and radially spaced apart from the central axis of the bit body;

a plurality of fixed-blade cutting elements arranged on the at least one fixed blade, at least one of the plurality of fixed-blade cutting elements being located proximal the central axis of the bit body, another of the plurality of fixed-blade cutting elements being located proximal the gage surface of the bit body, wherein the plurality of rolling-cutter cutting elements and the plurality of fixed-blade cutting elements combine to define a cutting profile that extends from substantially the central axis to the gage surface of the bit body, the profile having a cone region defining a selected angle relative to horizontal and a curve connecting the cone region to a gage region that is aligned with the gage surface of the bit body, the curve being tangent to the gage surface of the bit body; and wherein the curve has a compound radius, the curve having a nose portion and a shoulder portion, each having a radius different from the other.

27. The earth-boring bit according to claim 26, wherein the plurality of rolling-cutter cutting elements and the plurality of fixed-blade cutting elements are arranged and configured to cut a substantially congruent surface in the nose and shoulder portions of the profile.

28. The earth-boring bit of claim 26, wherein the at least one rolling cutter has leading and trailing sides and is next to and leading the at least one fixed blade with respect to a direction of rotation of the bit, the bit having a junk slot formed between the trailing side of the at least one rolling cutter, the leading edge of the at least one fixed blade, and a portion of the bit body, the junk slot providing an area for removal of disintegrated formation material, the junk slot being equal to or larger in at least an angular dimension than a space between the leading side of the at least one rolling cutter and a trailing edge of a next leading fixed blade with respect to the direction of rotation of the bit.

29. The earth-boring bit of claim 26, wherein the plurality of fixed-blade cutting elements form substantially all of the cutting profile at the central axis and the gage surface, and the plurality of rolling-cutter cutting elements at least partially overlap the plurality of fixed-blade cutting elements between the central axis and the gage surface.

30. The earth-boring bit of claim 26, further comprising at least one nozzle mounted in the bit body proximal the central axis, the at least one nozzle arranged to direct a stream of pressurized drilling fluid between the leading edge of the at least one fixed blade and the at least one rolling cutter.

31. The earth-boring bit of claim 30, wherein the at least one nozzle further comprises:

at least one fixed blade nozzle proximal the central axis of the bit body, the at least one fixed blade nozzle arranged to direct a stream of drilling fluid toward the plurality of fixed-blade cutting elements on the at least one fixed blade; and at least one rolling cutter nozzle spaced from the central axis of the bit body, the at least one rolling cutter nozzle arranged to direct a stream of drilling fluid toward the at least one rolling cutter.

32. The earth-boring bit of claim 26, wherein at least one of the plurality of fixed-blade cutting elements is within approximately 0.040 inches of the central axis.

33. The earth-boring bit of claim 26, further comprising a plurality of backup cutting elements arranged in at least one row extending generally parallel to the leading edge of the at least one fixed blade.

34. The earth-boring bit of claim 26, wherein the at least one rolling cutter has a leading side and is next to and leading the at least one fixed blade with respect to a direction of rotation of the bit, and wherein the leading side of the at least one rolling cutter is at least partially in front of a trailing edge of a next leading fixed blade with respect to the direction of rotation of the bit.

* * * * *